US010686270B2

(12) United States Patent
Zhou

(10) Patent No.: US 10,686,270 B2
(45) **Date of Patent: *Jun. 16, 2020**

(54) MODULAR PLUG WITH METAL SHIELDING COVER AND COMMUNICATION CABLE

(71) Applicant: SHENZHEN QINTONG TECHNOLOGY CO., LTD, Shenzhen (CN)

(72) Inventor: Shengling Zhou, Guangdong (CN)

(73) Assignee: SHENZHEN QINTONG TECHNOLOGY CO., LTD, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/714,827

(22) Filed: Dec. 16, 2019

(65) Prior Publication Data

US 2020/0119478 A1 Apr. 16, 2020

Related U.S. Application Data

(63) Continuation of application No. 16/173,804, filed on Oct. 29, 2018, now Pat. No. 10,511,113, which is a continuation of application No. PCT/CN2016/080550, filed on Apr. 28, 2016.

(51) Int. Cl.

| | |
|---|---|
| ***H01R 13/6581*** | (2011.01) |
| ***H01R 13/05*** | (2006.01) |
| ***H01R 13/04*** | (2006.01) |
| ***H01R 13/658*** | (2011.01) |

(Continued)

(52) U.S. Cl.

CPC ..... *H01R 13/05* (2013.01); *H01R 13/04* (2013.01); *H01R 13/46* (2013.01); *H01R 13/658* (2013.01); *H01R 13/6581* (2013.01); *H01R 43/16* (2013.01); *H01R 2201/04* (2013.01)

(58) Field of Classification Search

CPC ..... H01R 13/6581; H01R 13/6592; H01R 24/62; H01R 24/64

See application file for complete search history.

(56) References Cited

U.S. PATENT DOCUMENTS 4,457,575 A * 7/1984 Davis ..... H01R 13/64 439/607.43

4,569,566 A * 2/1986 Triner ..... H01R 12/79 439/392

(Continued)

*Primary Examiner* — Tho D Ta

(74) *Attorney, Agent, or Firm* — Andrew C. Cheng

(57) ABSTRACT

A modular plug includes a modular plug body and a metal shielding cover. The modular plug body has an inner chamber. The modular plug body has a first end and an opposite side end. Metal terminals are disposed at the first end. The second end defines an opening in communication with the inner chamber. The opening is configured to allow a cable to be inserted through the opening into the inner chamber. The metal shielding cover is attached around the modular plug body. The modular plug body defines a first aperture in communication with the inner chamber, and the metal shielding cover includes at least one metal spring tab capable of bending and deforming into the first aperture. The modular plug has a simple structure and ingenious design, which can easily achieve the grounding results, has a reduced cost, and is easy to promote its application.

20 Claims, 4 Drawing Sheets

(51) Int. Cl.
*H01R 13/46* (2006.01)
*H01R 43/16* (2006.01)

(56) References Cited

U.S. PATENT DOCUMENTS 4,838,811 A * 6/1989 Nakamura ..... H01R 13/6583
439/607.26
5,035,649 A * 7/1991 Collier ..... H01R 13/6599
439/290

* cited by examiner

MODULAR PLUG WITH METAL SHIELDING COVER AND COMMUNICATION CABLE

CROSS REFERENCE TO RELATED APPLICATIONS

This application is a continuation application of co-pending U.S. patent application Ser. No. 16/173,804, filed on Oct. 29, 2018, which is a continuation of International Application No. PCT/CN2016/080550, filed on Apr. 28, 2016, the contents of which are incorporated herein by reference.

FIELD

The present invention relates to modular plugs and, more particularly, to a modular plug with a metal shielding cover, and a communication cable.

BACKGROUND

A modular plug is an important connection component used in cable connection, especially in network connection. The modular plug is a plastic plug that can be inserted into a device port along a fixed direction and prevent it from becoming disengaged from the device port. The modular plug is mainly used to connect devices such as network cards, hubs, switches and telephones, and is suitable for field connection between devices or horizontal sub systems.

In order to enhance signal quality and reduce interference, a new solution is to provide a metal shielding cover over a modular plug body. An earth line is soldered to the metal shielding cover to avoid interference and shield noise signals. However, the current method of grounding the modular plug by using the metal shielding cover is complex and can be hard to implement. Also, this method leads to high cost, which can be difficult to promote its application.

SUMMARY

Accordingly, the present invention provides a modular plug having a metal shielding cover that can easily achieve grounding results.

The present invention also provides a communication cable.

A modular plug having a metal shielding cover includes a modular plug body and the metal shielding cover. The modular plug body has an inner chamber. The modular plug body has a first end and an opposite second end. Metal terminals are disposed at the first end. The second end defines an opening in communication with the inner chamber. The opening is configured to allow a cable to be inserted through the opening into the inner chamber. The metal shielding cover is attached around the modular plug body. The modular plug body defines a first aperture in communication with the inner chamber, and the metal shielding cover includes at least one metal spring tab that is disposed corresponding to the first aperture and is capable of bending and deforming into the first aperture.

In one embodiment, the modular plug body comprises a plurality of body sidewalls cooperatively forming the inner chamber, and the first aperture is defined through one of the body sidewalls.

In one embodiment, a pressing resilient tab for snappingly connecting with a connector port is connected to another one of the body sidewalls, and the connector port is configured to receive and electrically connect with the modular plug.

In one embodiment, the modular plug body comprises four body sidewalls including a first body sidewall, a second body sidewall, a third body sidewall, and a fourth body sidewall, the four body sidewalls cooperatively forming the inner chamber, the first body sidewall positioned opposite to the third body sidewall, the second body sidewall positioned opposite to the fourth body sidewall, the first aperture is defined in the second body sidewall, the metal shielding cover defines a second aperture corresponding to the first aperture, and the pressing resilient tab is disposed on the fourth body sidewall.

In one embodiment, the metal shielding cover comprises a first cover sidewall, a second cover sidewall, and a third cover sidewall, the first cover sidewall and the third cover sidewall extend respectively from two opposite sides of the second cover sidewall, the second aperture is defined between the first cover sidewall and the third cover sidewall, and the at least one metal spring tab is rotatably connected to the first cover sidewall and/or the third cover sidewall.

In one embodiment, the number of the at least one metal spring tab is two, and the two metal spring tabs are respectively connected to the first cover sidewall and the third cover sidewall.

In one embodiment, each metal sprint tab includes a free end pointing toward the other metal spring tab, the free end defines a cutout at one side thereof, and the cutouts of the two free ends are staggered with each other, such that rotating operations of the two metal spring tabs do not interfere with each other.

In one embodiment, the opening at the second end is cooperatively formed by a first frame section, a second frame section, a third frame section, and a fourth frame section, each frame section includes a frame section inner side at the opening and a frame section outer side opposite the opening, the second frame section bends and projects outwardly such that a concave surface is formed on the frame section inner side of that bent frame section and a convex surface is formed on the frame section outer side of that bent frame section.

In one embodiment, a first metal tab extends toward the third cover sidewall from an edge of the first cover sidewall away from the second cover sidewall, and a third metal tab extends toward the first cover sidewall from an edge of the third cover sidewall away from the second cover sidewall, and the first metal tab and the third metal tab closely contact the second frame section.

The present invention further provides communication cable comprising a cable and a modular plug connected to an end of the cable. The modular plug includes a modular plug body and a metal shielding cover. The modular plug body has an inner chamber. The metal shielding cover is attached around the modular plug body. The modular plug body has a first end and an opposite side end. Metal terminals are disposed at the first end. The second end defines an opening in communication with the inner chamber. The cable includes a plurality of electrical conductors, a shielding mask wrapped around the electrical conductors, and a cable jacket wrapped around the shielding mask. The end of the cable is inserted through the opening into the inner chamber and electrically connects with the metal terminals. The modular plug body defines a first aperture in communication with the inner chamber, and the metal shielding cover includes at least one metal spring tab that is disposed corresponding to the first aperture and is capable of bending and deforming into the first aperture, such that the at least one metal spring tab abuts against the shielding mask when bending and deforming into the first aperture.

In summary, the present invention provides a modular plug having a metal shielding cover. The metal shielding cover is attached around the modular plug body. The modular plug body defines a first aperture in communication with the inner chamber. The metal shielding cover defines a second aperture corresponding to the first aperture. The cable includes a shielding mask wound around the plurality of electrical conductors. The metal shielding cover includes the metal spring tab that is disposed corresponding to the first aperture and is capable of bending and deforming into the first aperture, such that the metal spring tab can abut against the shielding mask when bending and deforming into the first aperture, thus achieving the grounding and shielding results. The modular plug having the metal shielding cover has a simple structure and ingenious design, which can easily achieve the grounding results, has a reduced cost, and is easy to promote its application.

DESCRIPTION OF THE EMBODIMENTS

Figure 1:
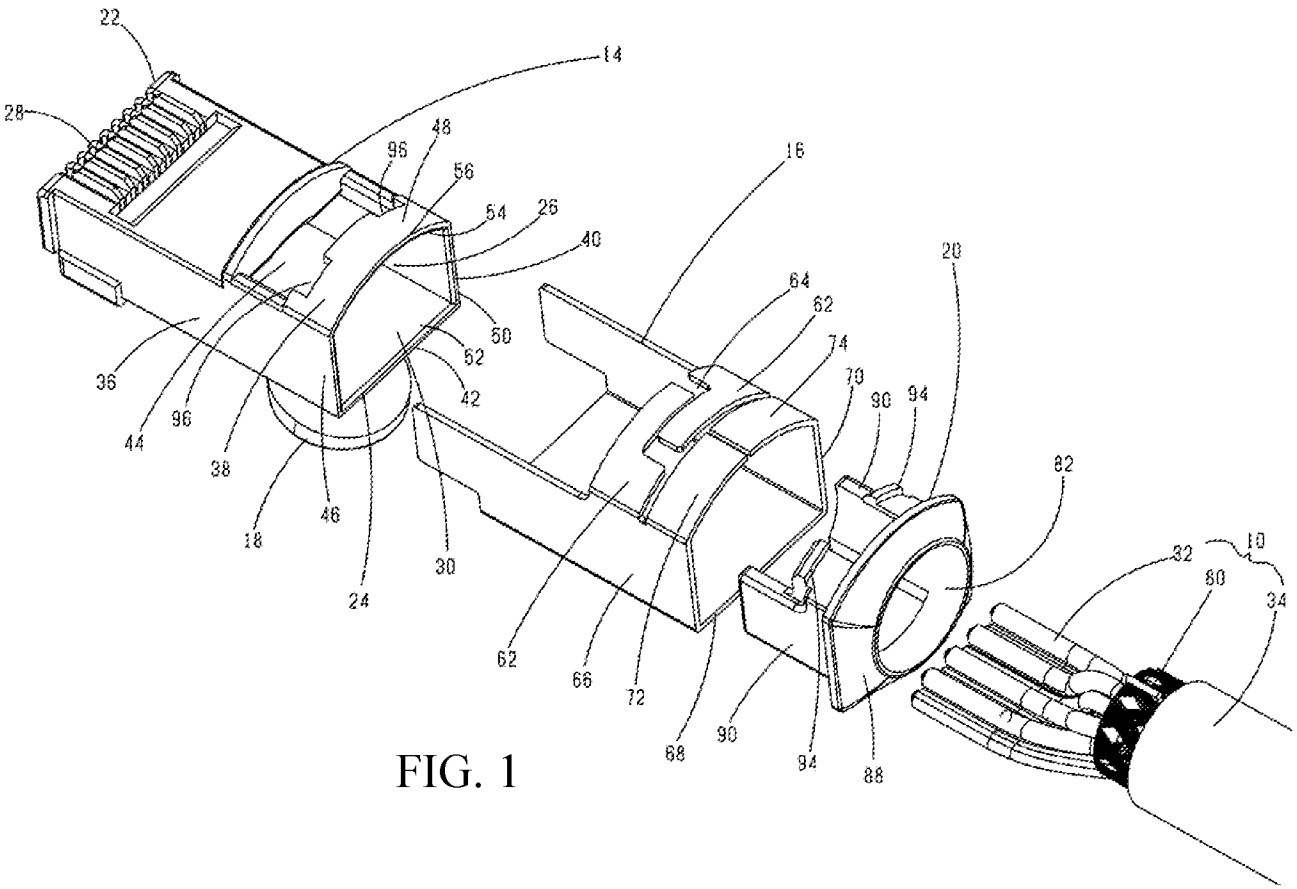
FIG. 1 is an exploded view of a modular plug and a communication cable according to one embodiment of the present invention.
Figure 2:
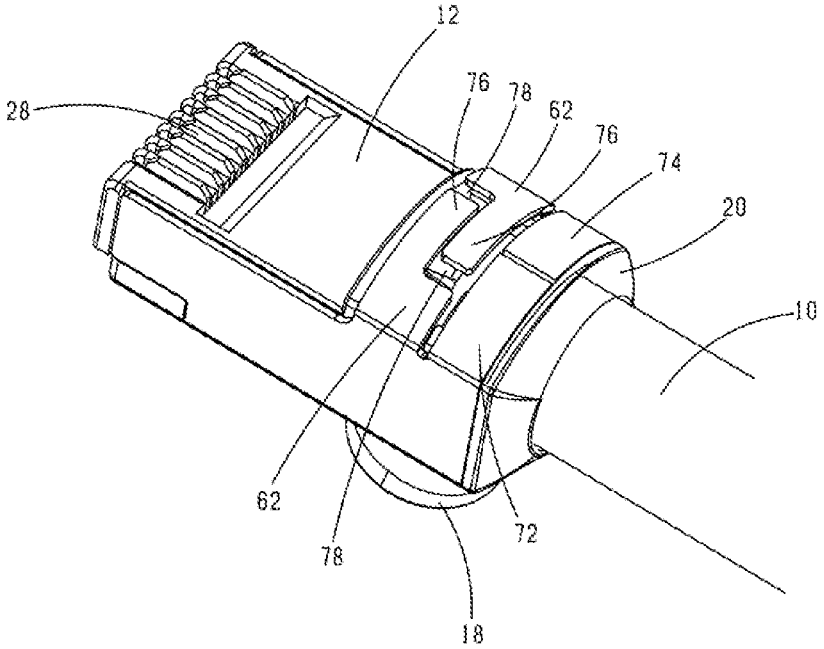
FIG. 2 is an assembled view of the modular plug and the communication cable of FIG. 1.
Figure 3:
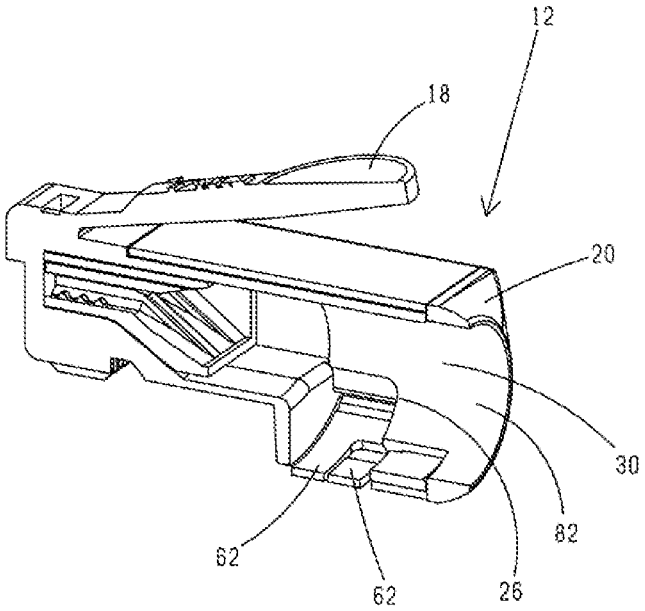
FIG. 3 is a perspective, sectional view of the modular plug of FIG. 1.
Figure 4:
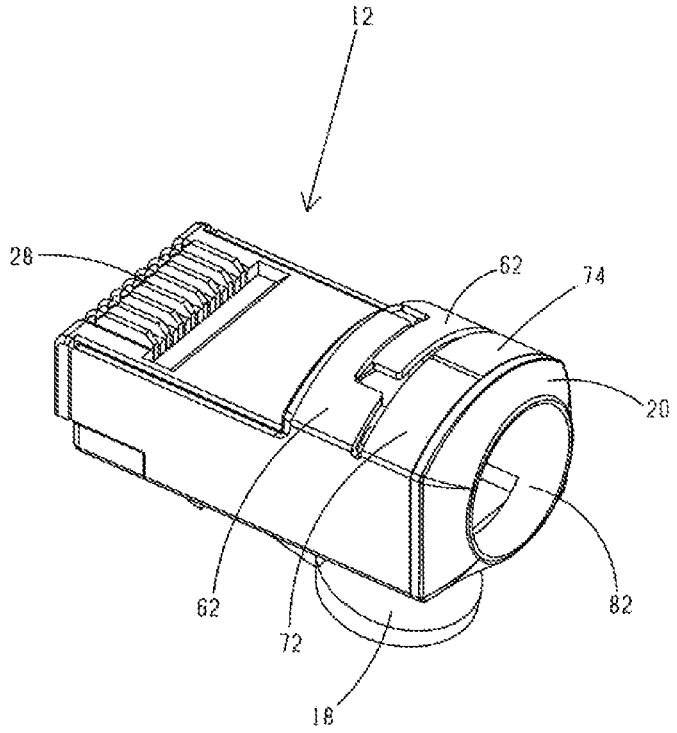
FIG. 4 is a perspective view of the modular plug of FIG. 1.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items.

Referring to FIG. 1 to FIG. 5, a communication cable according to one embodiment of the present invention includes a cable 10 and a modular plug 12 connected to one end of the cable 10. The modular plug 12 includes a modular plug body 14, a metal shielding cover 16, a pressing resilient tab 18, and a first insert 20.

The modular plug body 14 includes a first end 22, a second end 24 opposite to the first end 22, and an inner chamber 26 formed between the first end 22 and the second end 24. Metal terminals 28 are disposed at the first end 22. The second end 24 defines an opening 30 in communication with the inner chamber 26. The first insert 20 is mounted within the opening 30. The cable 10 includes a plurality of electrical conductors 32 and a cable jacket 34 wrapped around the electrical conductors 32. One end of the cable 10 extends through the opening 30 into the inner chamber 26 to electrically connect with the metal terminals 28 at the first end 22 of the modular plug 12.

In the illustrated embodiment, the modular plug body 14 includes four body sidewalls, i.e. a first body sidewall 36, a second body sidewall 38, a third body sidewall 40, and a fourth body sidewall 42. The four body sidewalls cooperatively define the inner chamber 26 of the modular plug body 14. The first body sidewall 36 is disposed opposite to the third body sidewall 40, and the second body sidewall 38 is disposed opposite to the fourth body sidewall 42. The second body sidewall 38 defines a first aperture 44 in communication with the inner chamber 26. The pressing resilient tab 18 is connected to the fourth body sidewall 42 and is used to snappingly connect with a connector port. The connector port is a port on an electronic device, which receives and electrically connects with the modular plug 12.

The opening 30 at the second end 24 of the modular plug 12 is cooperatively formed by a plurality of frame sections of the modular plug body 14. Each frame section includes a frame section inner side at the opening 30 and a frame section outer side opposite the opening 30. One of the frame sections bends and projects outwardly such that a concave surface is formed on the frame section inner side of that bent frame section and a convex surface is formed on the frame section outer side of that bent frame section.

In this illustrated embodiment, the opening 30 of the modular plug 12 is cooperatively formed by four frame sections, including a first frame section 46, a second frame section 48, a third frame section 50, and a fourth frame section 52. The first frame section 46 and the third frame section 50 are located at two opposite short sides, the second frame section 48 and the fourth frame section 52 are located at two opposite long sides, and the frame section that bends and projects outwardly is one of the frame sections located at the long sides. The four frame sections are disposed at outer edges of the four body sidewalls at the second end 24 of the modular plug body 14. Specifically, the first frame section 46 is disposed at the outer edge of the first body sidewall 36, the second frame section 48 is disposed at the outer edge of the second body sidewall 38, the third frame section 50 is disposed at the outer edge of the third body sidewall 40, and the fourth frame section 52 is disposed at the outer edge of the fourth body sidewall 42. The second frame section 48 is located between the first aperture 44 and the second end 24.

Figure 5:
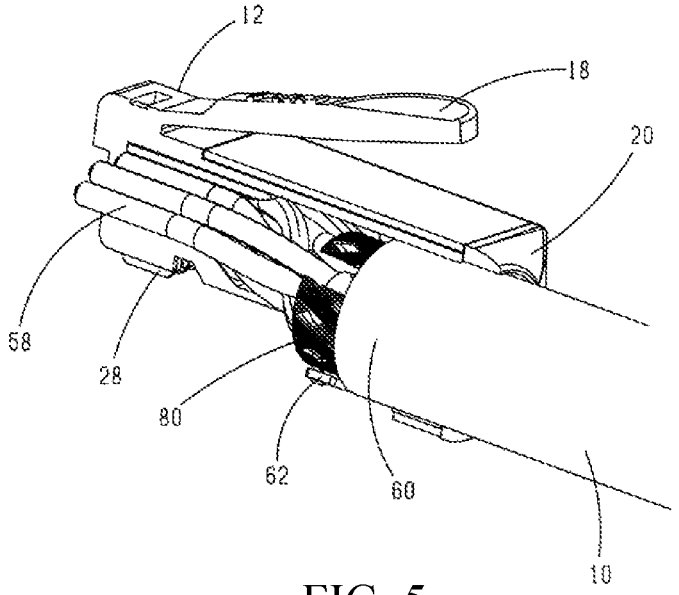
FIG. 5 is a partial sectional view of a modular plug and a cable connected together.

In this embodiment, the frame section that bends and projects outwardly is the second frame section 48. The second frame section 48 includes a frame section inner side 54 at the opening 30 and a frame section outer side 56 opposite the opening 30. The second frame section 48 bends and projects outwardly to form a curved concave surface on the frame section inner side 54 facing the opening 30 and form a curved convex surface on the frame section outer side 56 opposite the opening 30, corresponding to the curved concave surface. With the frame section bending and projecting outwardly, the opening 30 and the inner chamber 26 is enlarged without modifying the overall structure of the modular plug 12. When the cable 10 is inserted into the inner chamber 26, the cable 10 can be inserted into the inner chamber 26 together with the cable jacket 34, and only the cable jacket 34 on a portion of the cable 10 adjacent the metal terminals 28 needs to be stripped off. In other words, the portion of the cable 10 inserted into the inner chamber 26 includes a cable section 58 with the cable jacket removed and a cable section 60 having the cable jacket (FIG. 5). As a result, for the section of the cable 10 inserted into the inner chamber 26, damage to a lay of twisted conductors occur only at a portion of the section of the cable 10 inserted into the inner chamber 26. This damage will not cause a large crosstalk. Therefore, the present invention can greatly reduce the damage to the lay of the twisted conductors inside the inner chamber 26, thus reducing the signal crosstalk.

The pressing resilient tab 18 is connected to a side of the modular plug body 14 on which the fourth frame section 52 is disposed. That is, the frame section on the same side as the pressing resilient tab 18 is opposite to the frame section that bends and projects outwardly. When the modular plug 12 is inserted into the port of the electronic device, the pressing resilient tab 18 snappingly and resiliently engages in the port to lock the modular plug 12, preventing it from becoming disengaged accidentally. Construction and function of the pressing resilient tab 18 are well known in the art, explanations of which are therefore not repeated herein.

Although the concave surface and convex surface are designed to be curved surfaces in this embodiment, it should be understood that they can equally be of another shape, such as, V-shaped concave surface and V-shaped convex surface, or arc-shaped concave surface and arc-shaped convex surface, as long as the cross section of the opening 30 can be enlarged and design specifications are met. Therefore, the convex and concave surfaces of the present invention should not be limited to any particular shape.

While the opening 30 of the modular plug is illustrated as being cooperatively formed by four frame sections in this embodiment, the opening 30 may also be cooperatively formed by another number of frame sections according to needs, as long as the cross section of the opening 30 can be enlarged and design specifications are met. Therefore, the number of the frame sections of the present invention should not be limited to any particular value.

The metal shielding cover 16 is attached around the modular plug body 14. The metal shield cover 16 includes at least one metal spring tab 62 corresponding to the first aperture 44, the at least one metal spring tab 62 capable of bending and deforming into the first aperture 44.

Specifically, referring to FIG. 1, the metal shielding cover 16 defines a second aperture 64 corresponding to the first aperture 44. The metal shielding cover 16 includes a first cover sidewall 66, a second cover sidewall 68, and a third cover sidewall 70. The first cover sidewall 66 and the third cover sidewall 70 extend from two opposite sides of the second cover sidewall 68, respectively. After the metal shielding cover 16 is attached around the modular plug body 14, the first shielding cover 66 closely contacts the first body sidewall 36, the second cover sidewall 68 closely contacts the fourth body sidewall 42, and the third cover sidewall 70 closely contacts the third body sidewall 40. The first aperture 44 is formed in the second body sidewall 38, the second aperture 64 is formed between the first cover sidewall 66 and the third cover sidewall 70, and the at least one metal spring tab 62 is rotatably connected to the first cover sidewall 66 and/or the third cover sidewall 70. In this embodiment, there are two metal spring tabs 62, and the two metal spring tabs 62 are rotatably connected to the first cover sidewall 66 and the third cover sidewall 70, respectively. A first metal tab 72 extends toward the third cover sidewall 70 from an edge of the first cover sidewall 66 away from the second cover sidewall 68, and a third metal tab 74 extends toward the first cover sidewall 66 from an edge of the third cover sidewall 70 away from the second cover sidewall 68. After the metal shielding cover 16 is attached around the modular plug body 14, the first metal tab 72 and the third metal tab 74 closely contact the second frame section 48.

In the illustrated embodiment, each of the metal spring tabs 62 has a free end 76 pointing toward the other metal spring tab. A cutout 78 is formed at one side of each free end 76, and the cutouts 78 of the two free ends 76 are staggered from each other, such that rotating operations of the two metal spring tab 62 do not interfere with each other.

Referring to FIG. 1 and FIG. 5, the cable 10 includes the plurality of electrical conductors 32, a shielding mask 80 wrapping around the electrical conductors 32, and the cable jacket 34 wrapping around the shielding mask 80. The cable 10 further includes an earth line electrically connected with the shielding mask 80. For the section of the cable 10 inside the modular plug 12, there is a portion of the section of the cable 10 on which the cable jacket 34 is removed. When the metal spring tabs 62 bend and deform into the first aperture 44, the metal spring tabs 62 abut against and hence electrically contact with the shielding mask 80, thus achieving grounding and shielding results. Therefore, assembly of the modular plug 12 with the cable 10 can be accomplished simply by removing a section of the cable jacket 34 at the end of the cable 10, removing a section of the shielding mask 80 at the end of the cable 10 while leaving a section of the shielding mask 80 adjacent the cable jacket 34, inserting the end of the cable 10 into the inner chamber 26 of the modular plug 12, and pressing the metal spring tabs 62 into the first aperture 44 so that the metal spring tabs 62 abut against and hence electrically connect with the shielding mask 80. This assembly process is simple and is able to achieve good grounding and shielding results. In order to achieve good electrical contact, the section of the shielding mask 80 left on the end of the cable 10 inside the inner chamber 26 of the modular plug 12 needs to extend to a position corresponding to at least one of the metal spring tabs 62. This way, good grounding and shielding results can be achieved simply by pressing the metal spring tabs 62.

In the illustrated embodiment, the free ends 76 of the metal spring tabs 62 have cutouts 78 that are staggered with each other so that rotating operations of the two metal spring tab 62 do not interfere with each other. It should be understood that this is for the purposes of illustration only and should not be regarded as limiting. In other embodiments, the free end may have other configurations, e.g. the free ends 76 are formed with teeth that are meshed with each other.

It should also be understood that the number of the metal spring tab 62 may be one or more than two according to needs in other embodiments.

Figure 6:
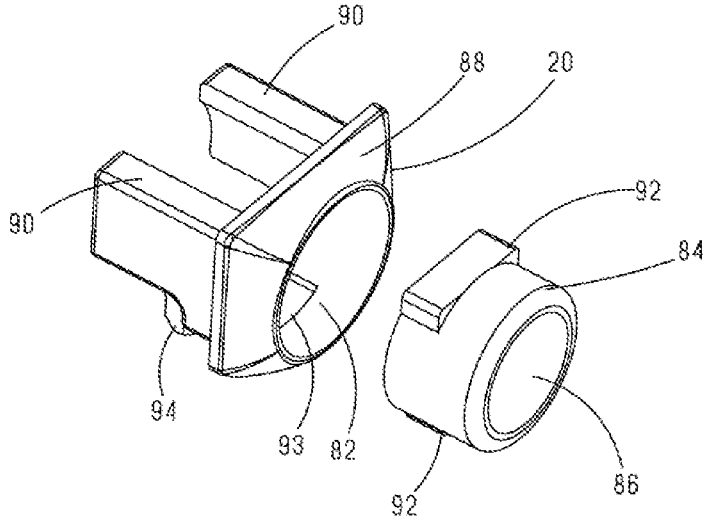
FIG. 6 is a perspective, exploded view of an insert for a modular plug according to a second embodiment of the present invention.
Figure 7:
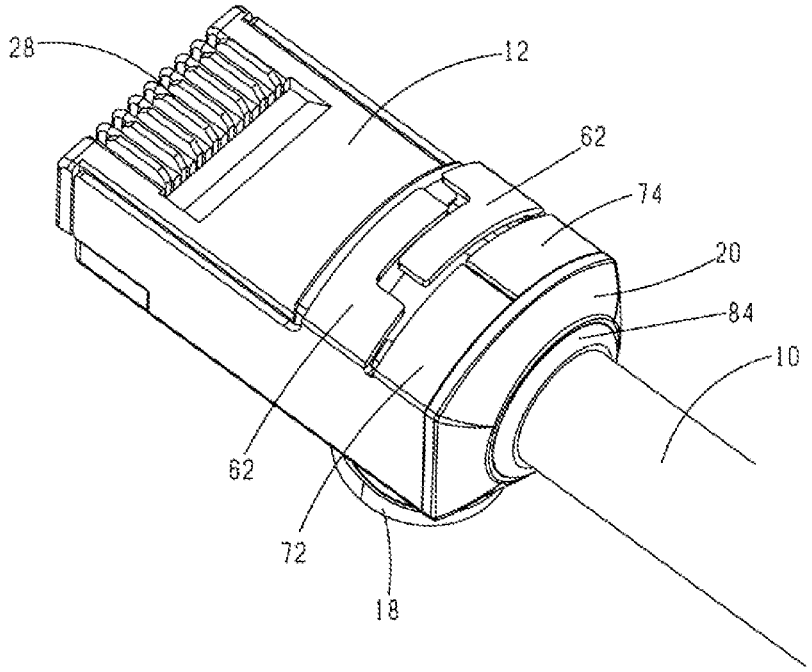
FIG. 7 is an assembled view of a modular plug having the insert of FIG. 6 and a cable connected with the modular plug.

The first insert 20 is mounted within the opening 30. The first insert 20 has an inner bore 82 in communication with the inner chamber 26. In order to accommodate various diameter sizes of the cable, the modular plug 12 further includes a second insert 84. Referring to FIG. 6 and FIG. 7, the second insert 84 is removably mounted in the inner bore 82 of the first insert 20. The second insert 84 has an inner bore 86 in communication with the inner chamber 26. One end of the cable 10 is inserted through the inner bore 86 of the second insert 84 into the inner chamber 26 to electrically connect with the metal terminals 28, and the second insert 84 is sandwiched between an outer surface of the cable jacket 34 and an inner surface of the first insert 20.

In the illustrated embodiment, the first insert 20 is a hard rubber insert configured to be press-fit into the opening 30. The inner bore 82 of the first insert 20 is a round inner bore 82. The second insert 84 is an annular second insert 84 for engagement into the round inner bore 82. The second insert 84 is a soft insert, such as an elastomer gasket. The elastic compressibility of the second insert 84 enables the cable 10 and the second insert 84 to be closely pressed against each other. The inner bore 86 of the second insert 84 is a round inner bore 86 for receiving the cable 10. It should be understood that designing the first insert 20 as a hard rubber insert and designing the second insert 84 as an elastomer gasket are only one exemplary embodiment. In other embodiments, the first insert 20 and the second insert 84 may also be made of another material.

The first insert 20 includes an insert head 88 matching the shape of the opening 30, and insert walls 90 extending into the inner chamber 26. After the first insert 20 is inserted into the inner chamber 26, the insert walls 90 abut against inner surfaces of the modular plug body 14, thereby positioning the first insert 20 relative to the modular plug body 14. In this embodiment, there are two insert walls 90 that are symmetrical with respect to each other.

At least one stop portion 92 is formed on a periphery of the second insert 84, which prevents the second insert 84 from becoming disengaged from the inner bore 82 of the first insert 20. In the illustrated embodiment, the at least one stop portion 92 includes two symmetrical stop portions 92 that project radially on the periphery of the second insert 84. In mounting the second insert 84 into the inner bore 82 of the first insert 20, the second insert 84 is inserted into the inner bore 82 of the first insert 20 from an inner end of the first insert 20, i.e. from the end of the first insert 20 on which the insert walls 90 are disposed. The two stop portions 92 are engaged against the inner end of the first insert 20 to prevent the second insert 84 from becoming disengaged from the inner bore 82 of the first insert 20 in case the cable 10 is being pulled. As shown in FIG. 6, the inner end of the first insert 20 defines stop slots 93 for engagement with the stop portions 92. It should be understood that the number of the stop portions 92 may be another value in another embodiment. In other embodiments, alternative measures could be taken to prevent the disengagement of the second insert 84 from the inner bore 82 of the first insert 20, or secure the second insert 84 in the inner bore 82 of the first insert 20.

In the illustrated embodiment, in order to make the connection between the first insert 20 and the modular plug body 14 more stable, the first insert 20 further includes a resilient catch 94 extending from the insert head 88 toward the inner chamber 26. The resilient catch 94 is capable of a small amount of resilient deflection in a vertical direction. Correspondingly, the modular plug body 14 defines a catch slot 96 for engagement with the resilient catch 94. In the illustrated embodiment, the catch slot 96 is formed on the second frame section 48 that bends and projects outwardly (i.e. the second body sidewall 38), and the catch slot 96 is in communication with the first aperture 44. Once the first insert 20 is pressed into the opening 30, the insert head 88 is disposed at the opening 30, the insert walls 90 abuts against the inner surfaces of the inner chamber 26 (i.e. the inner surfaces of the modular plug body 14), and the resilient catch 94 is engaged in the catch slot 96 to secure the first insert 20 to the modular plug body 14. In this embodiment, there are two resilient catches 94 and two catch slots 96. It should be understood that the numbers of the resilient catches 94 and the catch slots 96 may be other values in other embodiments.

In order to stably connect the first insert 20 with the modular plug body 14, the resilient catch 94 engages in the catch slot 96 in this embodiment. It should be understood that other implementation may be used in other embodiments and this should not be regarded as limiting.

In summary, the present invention provides a modular plug that can reduce the damage to the lay of twisted conductors in the modular plug. The opening of the modular plug is cooperatively formed by two opposite short frame sections and two opposite long frame sections. The opening is in communication with the inner chamber of the modular plug. Each frame section includes a frame section inner side at the opening and a frame section outer side opposite the opening. One of the long frame sections bends and projects outwardly such that a concave surface is formed on the frame section inner side of that bent frame section and a convex surface is formed on the frame section outer side of that bent frame section, thereby increasing the cross section area of the opening. The present invention further provides a communication cable. By increasing the cross section area of the opening, for the section of the cable inserted into the inner chamber, only a portion of the cable jacket on a portion of the inserted section of the cable needs to be removed, and another portion of the cable jacket adjacent the opening needs not to be removed, thereby shortening the length of the cable section where a lay of twisted conductors is damaged and hence effectively reducing the signal crosstalk between the twisted pairs and enhancing the network transmission results. Furthermore, the metal shielding cover includes the metal spring tab that can bend and deform into the first aperture to make the metal spring tab abut against the fielding mask. The metal shielding cover has a simple structure and ingenious design, which can achieve good shielding and grounding results. Moreover, the second insert is replaceably mounted in the inner bore of the first insert. The second insert may be freely replaced with a new one depending on the diameter of the cable, such that the modular plug can accommodate cables with various diameter sizes.

Although the invention is described with reference to one or more embodiments, it will be apparent to those skilled in the art that various modifications and variations can be made to the disclosed structure without departing from the scope or spirit of the invention. In view of the foregoing, it is intended that the present invention cover modifications and variations of this invention provided they fall within the scope of the following claims and their equivalents.

What is claimed is:

1. A modular plug comprising:

a modular plug body having an inner chamber and defining a first aperture in communication with the inner chamber, the modular plug body having a first end and an opposite second end, metal terminals being disposed at the first end, the second end defining an opening in communication with the inner chamber, the opening being configured to allow a cable to be inserted through the opening into the inner chamber; and a separate metal shielding cover attached around the modular plug body, the metal shielding cover including at least one metal spring tab that is disposed outside the first aperture, the at least one metal spring tab configured to bend and deform into the first aperture to abut against and electrically contact with a shielding mask of the cable only after the cable has been inserted into the inner chamber.

2. The modular plug of claim 1, wherein the modular plug body comprises a plurality of body sidewalls cooperatively forming the inner chamber, and the first aperture is defined through one of the body sidewalls.

3. The modular plug of claim 2, wherein the modular plug body comprises four body sidewalls including a first body sidewall, a second body sidewall, a third body sidewall, and a fourth body sidewall, the four body sidewalls cooperatively forming the inner chamber, the first body sidewall positioned opposite to the third body sidewall, the second body sidewall positioned opposite to the fourth body sidewall, the first aperture is defined in the second body sidewall, the metal shielding cover defines a second aperture corresponding to the first aperture.

4. The modular plug of claim 3, wherein the metal shielding cover comprises a first cover sidewall, a second cover sidewall, and a third cover sidewall, the first cover sidewall and the third cover sidewall extend respectively from two opposite sides of the second cover sidewall, the second aperture is defined between the first cover sidewall and the third cover sidewall, and each of the at least one metal spring tab is rotatably connected to one of the first cover sidewall and the third cover sidewall, and extends toward the other of the first cover sidewall and the third cover sidewall.

5. The modular plug of claim 4, wherein the number of the at least one metal spring tab is two, and the two metal spring tabs are respectively connected to the first cover sidewall and the third cover sidewall, each metal spring tab includes a free end pointing toward the other metal spring tab, the free end defines a cutout at one side thereof, and the cutouts of the two free ends are staggered with each other, such that rotating operations of the two metal spring tabs do not interfere with each other.

6. The modular plug of claim 1, wherein the opening at the second end is cooperatively formed by a first frame section, a second frame section, a third frame section, and a fourth frame section, each frame section includes a frame section inner side at the opening and a frame section outer side opposite the opening, the second frame section bends and projects outwardly such that a concave surface is formed on the frame section inner side of that bent frame section and a convex surface is formed on the frame section outer side of that bent frame section.

7. The modular plug of claim 6, wherein the metal shielding cover comprises a first cover sidewall, a second cover sidewall, and a third cover sidewall, the first cover sidewall and the third cover sidewall extend respectively from two opposite sides of the second cover sidewall, a second aperture is defined between the first cover sidewall and the third cover sidewall, corresponding to the first aperture, a first metal tab extends toward the third cover sidewall from an edge of the first cover sidewall away from the second cover sidewall, and a third metal tab extends toward the first cover sidewall from an edge of the third cover sidewall away from the second cover sidewall, and the first metal tab and the third metal tab closely contact the second frame section.

8. The modular plug of claim 1, further comprising a first insert mounted in the opening and a second insert replaceably mounted in an inner bore of the first insert, the second insert having an inner bore in communication with the inner chamber.

9. The modular plug of claim 8, wherein the first insert is a hard insert and the second insert is a soft insert.

10. A communication cable comprising:

a cable comprising a plurality of electrical conductors, a shielding mask wrapped around the electrical conductors, and a cable jacket wrapped around the shielding mask; and a modular plug connected to an end of the cable, the modular plug comprising:

a modular plug body having an inner chamber and defining a first aperture in communication with the inner chamber, the modular plug body having a first end and an opposite second end, metal terminals being disposed at the first end, the second end defining an opening in communication with the inner chamber; and a separate metal shielding cover attached around the modular plug body, the metal shielding cover including at least one metal spring tab;

wherein the at least one metal spring tab bends and deforms into the first aperture to abut against and electrically contact the shielding mask of the cable after the end of the cable is inserted through the opening into the inner chamber and electrically connects with the metal terminals.

11. The modular plug of claim 10, further comprising a first insert mounted in the opening and a second insert replaceably mounted in an inner bore of the first insert, the second insert having an inner bore in communication with the inner chamber, the cable extending through the inner bore of the second insert into the inner chamber.

12. The communication cable of claim 10, wherein the modular plug body comprises four body sidewalls including a first body sidewall, a second body sidewall, a third body sidewall, and a fourth body sidewall, the four body sidewalls cooperatively forming the inner chamber, the first body sidewall positioned opposite to the third body sidewall, the second body sidewall positioned opposite to the fourth body sidewall, the first aperture is defined in the second body sidewall, wherein the metal shielding cover comprises a first cover sidewall, a second cover sidewall, and a third cover sidewall, the first cover sidewall and the third cover sidewall extend respectively from two opposite sides of the second cover sidewall, a second aperture is defined between the first cover sidewall and the third cover sidewall, corresponding to the first aperture, and the at least one metal spring tab is rotatably connected to an edge of the first cover sidewall and/or the third cover sidewall at the second aperture.

13. The communication cable of claim 12, wherein the at least one metal spring tab extends in a direction perpendicular to an inserting direction of the cable.

14. The communication cable of claim 12, wherein the number of the at least one metal spring tab is two, and the two metal spring tabs are respectively connected to the first cover sidewall and the third cover sidewall, each metal spring tab includes a free end pointing toward the other metal spring tab, the free end defines a cutout at one side thereof, and the cutouts of the two free ends are staggered with each other, such that rotating operations of the two metal spring tabs do not interfere with each other.

15. The communication cable of claim 12, wherein the opening at the second end is cooperatively formed by a first frame section, a second frame section, a third frame section, and a fourth frame section, each frame section includes a frame section inner side at the opening and a frame section outer side opposite the opening, the second frame section bends and projects outwardly such that a concave surface is formed on the frame section inner side of that bent frame section and a convex surface is formed on the frame section outer side of that bent frame section.

16. A method of assembling a communication cable, comprising:

inserting an end of a cable into an inner chamber of a modular plug, wherein the cable comprises a plurality of electrical conductors, a shielding mask wrapped around the electrical connectors, and a cable jacket wrapped around the shielding mask, with a section of the cable jacket at the end of the cable removed, and a section of the shielding mask at the end of the cable removed to expose the electrical connectors while leaving a section of the shielding mask adjacent the cable jacket wherein the modular plug comprises a modular plug body and a separate metal shielding cover attached around the modular plug body, the modular plug body having the inner chamber and defining a first aperture in communication with the inner chamber, the modular plug body having a first end and an opposite second end, metal terminals being disposed at the first end, the second end defining an opening in communication with the inner chamber, the end of the cable being inserted through the opening into the inner chamber, the metal shielding cover including at least one metal spring tab; and after the cable has been inserted into the modular plug, pressing the at least one metal spring tab into the first aperture so that the at least one metal spring tab abuts against and electrically connects with the shielding mask.

17. The method of claim 16, wherein the at least one metal spring tab extends in a direction perpendicular to an inserting direction of the cable.

18. The method of claim 16, wherein the at least one metal spring tab comprises two metal spring tabs, and the two metal spring tabs are respectively connected to two of a plurality of cover sidewalls of the metal shielding cover.

19. The method of claim 18, wherein each metal spring tab includes a free end pointing toward the other metal spring tab, the free end defines a cutout at one side thereof, and the cutouts of the two free ends are staggered with each other, such that rotating operations of the two metal spring tabs do not interfere with each other.

20. The method of claim 18, wherein the modular plug comprises a first insert mounted in the opening and a second insert replaceably mounted in an inner bore of the first insert, the second insert having an inner bore in communication with the inner chamber, the cable extending through the inner bore of the second insert into the inner chamber.

* * * * *